US012383039B1

(12) United States Patent
Siharath

(10) Patent No.: US 12,383,039 B1
(45) Date of Patent: Aug. 12, 2025

(54) ELASTIC SLIM HAIR TOWEL WRAP

(71) Applicant: Douang Siharath, Irving, CA (US)

(72) Inventor: Douang Siharath, Irving, TX (US)

(73) Assignee: Douang Siharath, Irving, TX (US)

( * ) Notice: Subject to any disclaimer, the term of this patent is extended or adjusted under 35 U.S.C. 154(b) by 0 days.

(21) Appl. No.: 19/051,531

(22) Filed: Feb. 12, 2025

Related U.S. Application Data

(60) Provisional application No. 63/552,850, filed on Feb. 13, 2024.

(51) Int. Cl.
*A42B 1/041* (2021.01)
*A45D 20/00* (2006.01)

(52) U.S. Cl.
CPC ..... *A45D 20/00* (2013.01); *A42B 1/041* (2013.01)

(58) Field of Classification Search
CPC ..... A42B 1/046; A42B 1/041; A42B 1/049; A45D 8/40; A41D 23/00
USPC ..... D2/867
See application file for complete search history.

(56) References Cited

U.S. PATENT DOCUMENTS

D39,940 S * 4/1909 Burchard ..... D2/880
1,061,991 A * 5/1913 Drullard ..... A42B 1/041 2/204
1,068,146 A * 7/1913 Loeffelholz ..... A42B 1/16 2/202
1,139,967 A * 5/1915 Hall ..... A42B 1/045 2/209.11
1,203,870 A * 11/1916 Hallam et al. ..... A42B 1/045 2/203
1,563,693 A * 12/1925 Drucks ..... A45D 8/40 132/274
1,589,185 A * 6/1926 Lithgow ..... A45D 8/40 132/273
1,610,480 A * 12/1926 Seilaz ..... A45D 8/40 132/274
1,616,800 A * 2/1927 Hogan ..... A45D 8/40 132/274
2,104,997 A * 1/1938 Lawrence ..... A42B 1/012 2/200.1
D108,831 S * 3/1938 Forman ..... D2/880
D130,741 S * 12/1941 Brenner ..... D2/880
(Continued)

FOREIGN PATENT DOCUMENTS

JP 2007502919 2/2007
RU 2794013 4/2023

*Primary Examiner* — Jillian K Pierorazio
(74) *Attorney, Agent, or Firm* — Perkins Coie LLP

(57) ABSTRACT

A hair towel wrap features an elastic band seamlessly integrated into the rear of a head portion and is designed for enhanced stability and comfort during hair drying. The wrap includes a towel cloth with specific dimensions for the head, body, and tail portions, providing coverage for various hair types and lengths. The elastic band provides adjustable tension and secure positioning, while the trigon-shaped tail portion can be tucked under the band for additional stability. The elastic band is attached to a center of a back of the second towel cloth and can be substantially indented or not fully aligned with a head portion of a hair towel cloth. This design eliminates common issues with conventional hair towels, such as slipping and inadequate coverage, while promoting gentle, natural hair drying.

20 Claims, 9 Drawing Sheets

(56) References Cited

U.S. PATENT DOCUMENTS 2,439,382 A * 4/1948 De Grazla ..... A42B 1/048 2/84
D171,903 S * 4/1954 Litwin ..... D2/880
2,694,204 A 11/1954 Cross
2,720,883 A * 10/1955 King ..... A45D 8/40 132/274
2,735,283 A * 2/1956 Schuessler ..... A42B 1/045 2/202
3,392,737 A * 7/1968 Fefferman ..... A45D 8/40 132/274
3,676,879 A * 7/1972 Irie ..... A42B 1/045 2/202
D239,216 S * 3/1976 Kim et al. ..... D2/870
4,378,606 A * 4/1983 Snowden ..... A42B 1/041 2/200.1
5,365,613 A 11/1994 Henegan
5,490,528 A 2/1996 Day
5,615,416 A * 4/1997 Haddad ..... A41D 3/00 2/202
D381,790 S 8/1997 Harris et al.
D388,589 S 1/1998 Walker
D412,234 S * 7/1999 Cox ..... D2/867
5,920,909 A * 7/1999 Ellsworth ..... A42B 1/041 132/273
6,189,152 B1 * 2/2001 Lofton ..... A42B 1/041 2/174
6,427,251 B1 8/2002 Leach
D472,367 S * 4/2003 Maya ..... D2/880
D486,622 S * 2/2004 Matsuda ..... D2/867
6,738,986 B1 * 5/2004 Martin ..... A42B 1/041 2/207
D498,345 S 11/2004 Maya
D533,273 S 12/2006 Witt
7,412,729 B1 8/2008 McGovern
7,827,621 B2 11/2010 DaCruz
D632,058 S 2/2011 Pritchett
D641,140 S 7/2011 Clarke
8,032,950 B2 * 10/2011 Leftenant ..... A42B 1/041 2/202
D662,692 S * 7/2012 Asimenu ..... D2/880
D665,560 S * 8/2012 Shakir ..... D2/881
8,316,466 B2 11/2012 Saito
D701,679 S * 4/2014 Keppler ..... D2/881
9,138,025 B1 9/2015 Lunsford
9,439,492 B2 * 9/2016 Johnson ..... A45D 20/00
D782,786 S * 4/2017 Lloyd ..... D2/875
9,907,381 B2 3/2018 Tussey
D836,302 S * 12/2018 Alba ..... D2/867
D871,725 S * 1/2020 Smith ..... A42B 1/04 D2/878
10,694,799 B1 6/2020 Gonzalez
11,051,600 B2 7/2021 McKay
D927,892 S 8/2021 McKay
D935,138 S 11/2021 Zhang
D939,812 S 1/2022 Thurswell
11,330,885 B2 5/2022 Walker et al.
D962,598 S 9/2022 McKay
2003/0200594 A1 * 10/2003 McGreggor ..... A42B 1/041 2/202
2003/0221243 A1 * 12/2003 Phillips ..... A42B 1/049 2/202
2005/0097655 A1 * 5/2005 Bascom ..... A42B 1/225 2/171
2006/0048277 A1 * 3/2006 Yeadon ..... A42B 1/041 2/204
2006/0179544 A1 * 8/2006 Knievel ..... A42B 1/041 2/181
2007/0056079 A1 * 3/2007 Didier ..... A42B 1/041 2/171
2008/0000012 A1 * 1/2008 Adejare ..... A42B 1/041 2/171
2009/0025119 A1 1/2009 Nespor
2009/0151048 A1 * 6/2009 Laury ..... A45D 44/00 132/273
2010/0294301 A1 * 11/2010 Blasingame ..... A45D 8/40 132/274
2010/0299807 A1 12/2010 Saito
2012/0079643 A1 * 4/2012 Clarke ..... A42B 1/041 2/171
2015/0335087 A1 11/2015 Martin et al.
2016/0198830 A1 * 7/2016 Tussey ..... A42B 1/049 2/183
2017/0042268 A1 * 2/2017 Lessard ..... A42B 1/041
2017/0311692 A1 * 11/2017 Morgan ..... A45D 20/18
2018/0235411 A1 8/2018 Guerra-Sievers
2019/0037944 A1 * 2/2019 Tussey ..... A42B 1/049
2020/0121052 A1 4/2020 McKay
2021/0106086 A1 * 4/2021 Johnson ..... A42B 1/049
2021/0330015 A1 * 10/2021 Roemer ..... A42B 1/041
2021/0361048 A1 * 11/2021 McKay ..... A42B 1/006
2022/0151364 A1 * 5/2022 Park ..... A45D 44/02
2022/0202124 A1 * 6/2022 Grey ..... A42B 1/206
2022/0338590 A1 * 10/2022 Moore ..... A42B 1/049
2022/0346518 A1 * 11/2022 Cohen ..... A47K 10/02
2023/0010601 A1 * 1/2023 Garcia ..... A41D 23/00
2023/0172300 A1 6/2023 De Jesu
2023/0389638 A1 * 12/2023 Gallant ..... A42B 1/241

* cited by examiner

ELASTIC SLIM HAIR TOWEL WRAP

CROSS REFERENCE TO RELATED APPLICATIONS

The present application claims the benefit of U.S. Provisional Patent Application No. 63/552,850 filed on Feb. 13, 2024, which is incorporated herein by reference in its entirety.

TECHNICAL FIELD

The present application relates to a hair-drying apparatus, such as a hair towel wrap designed for drying longer, curly, or thicker wet hair.

BACKGROUND

People often need to dry their hair after their hair comes in contact with water, such as through showering or swimming. Rather than leaving wet hair to dry naturally by air circulation, which can be time-consuming, people usually prefer to dry their hair faster by heat (e.g., an electric hair dryer) or water absorption (e.g., a towel). However, high temperature from the electric hair dryer can cause damages to the hair while conventional towels often do not fit well, are challenging to achieve a secure fit, and/or tend to come loose when worn. There is a need for a more effective and user-friendly solution for drying wet hair, particularly for individuals with thick, curly, or long hair. While absorbent materials in towels have been used to remove excess moisture from hair, they often fail to provide sufficient effectiveness, comfort, and hair protection.

BRIEF DESCRIPTION OF THE DRAWINGS

FIGS. 4A, 4B, and 4C provide perspective and top views of this dual-layer configuration, demonstrating how the additional layer provides a more comprehensive hair drying solution. These figures showcase the dual-layer design that provides additional absorption and comfort while maintaining the secure fit enabled by the elastic band.

DETAILED DESCRIPTION

Figure 1A:
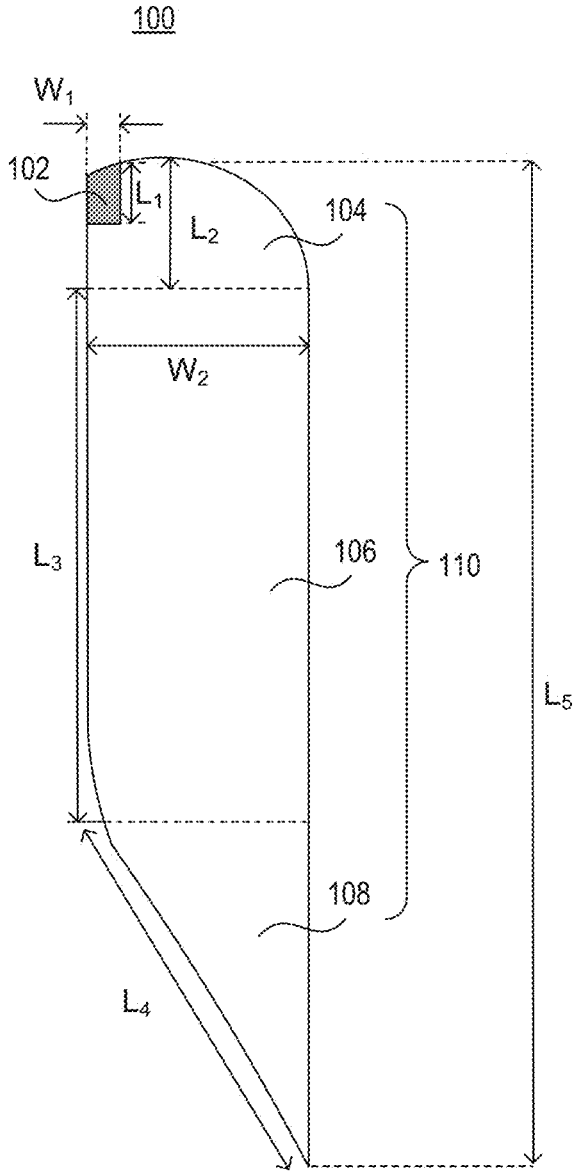
FIGS. 1A and 1B illustrate side views of a hair towel wrap in accordance with one or more embodiments, in which the hair towel wrap has an elastic band and a hair towel cloth including a head portion, body portion, and tail portion.

Apparatuses for drying wet hair and protecting dry hair are disclosed in the present application. For example, the present disclosure describes a hair-drying and protective apparatus, such as a hair towel wrap, designed for drying longer, curly, or thicker wet hair, as well as protecting dry hair while showering or bathing. The dual-purpose functionality allows the wearer to dry wet or damp hair or shield dry hair from moisture exposure. For example, the hair towel wrap can act as a protective barrier for dry hair during showers or moisture exposure. The hair towel wrap can also keep hair in place during dressing and grooming routines for added convenience.

The hair towel wraps described in the present application can be used for individuals with any hair type and length, and particularly for individuals with thick, curly, or long hair types. The hair towel wrap can include a snug-fit elastic band that extends over at least a portion of the head part, which a wearer may use to firmly secure the wrap on his or her head. The elastic band includes one or more pieces of elastic material so that the head part can extend securely over different head sizes. The conforming fit of the hair towel wrap of the present disclosure provides for enhanced security and stability of the wrap with superior utility and performance. Other advantages include, for example, absorbing excess water, promoting a healthier drying process, and reducing the need for heat styling. In contrast, previous hair pouches fail to provide a snug fit which in turn results in poor water absorption. The present disclosure provides functionality for dry hair as a protective barrier for hair during showers or moisture exposure as well as secured way to prevent hair from impeding a user during dressing and grooming routines.

The hair towel includes features that distinguish it from conventional hair towels. For example, the elastic band, which is seamlessly sewn into the rear of the cap portion, can serve multiple functions. It can enable precise size adjustments to provide a secure fit for any head size, effectively preventing the towel from slipping or unraveling during use. The hair towel thus prevents the need for additional fasteners while maintaining stability.

The back design includes a specialized construction where a 2-inch wide by 4-inch long elastic band is integrated into a 2-inch wide by 6-inch long cutout space. This configuration creates an intentionally gathered effect where the shorter elastic band contracts the fabric, producing even, wave-like folds. These gathered waves enhance the wrap's ability to conform to the wearer's head shape while providing improved stability and grip.

The distinctive slim shape provides advantages to the hair towel. By preventing unnecessary bulk and avoiding traditional hair pouches, the towel achieves a more streamlined profile that enhances comfort and functionality. The design consciously omits common elements like hooks, loops, buttons, or straps that can complicate use and compromise reliability.

The hair towel's user-friendly design emphasizes simplicity and effectiveness. The wearer can secure the towel by simply tucking the tail portion under the elastic band, creating a stable fit that requires little or no readjustment.

This straightforward securing mechanism provides more consistent performance without the need for frequent rewrapping or adjustments.

The elastic band's integration into the towel's structure is additionally advantageous. Positioned at the center back of the head portion, the band extends symmetrically to both sides of the wearer's head base. This placement allows the elastic to stretch and conform to the wearer's unique head shape and size, preventing slipping, unraveling, or sliding during use. The clastic band's dimensions and placement can be determined to provide improved tension and stability while allowing the towel to dry efficiently when hung.

In some embodiments, the hair towel wrap includes an elastic band sewn into the rear of a head portion, with dimensions chosen for improved fit and functionality. The wrap includes a body portion extending forward from the head portion with a rectangular shape and a tail portion extending from the body portion with a trigon shape. The elastic band provides stability while allowing for tension adjustment. In some implementations, the elastic band has a thickness of 0.5 mm to 3 mm. The hair towel wrap features a dual-layer design with a first towel cloth and a second towel cloth encompassing the elastic band. The second towel cloth matches the combined length of the head and body portions of the first towel cloth, providing additional absorption and comfort.

In some embodiments, the hair towel wrap includes an elastic band and a first towel cloth. The first towel cloth has three parts: a head portion, a body portion, and a tail portion. The elastic band attaches to the center of the back of the head portion. The body portion extends forward from the front of the head portion. The tail portion extends forward from the body portion and is long enough to be tucked under the elastic band when worn. Additionally, in some embodiments, the hair towel wrap further includes a second towel cloth that encompasses the elastic band and is positioned substantially between the first towel cloth and the elastic band. The second towel cloth's length substantially matches the total length of the head and body portions of the first towel cloth, and the elastic band attaches to the center of the back of the second towel cloth. In some embodiments, the elastic band is substantially indented from the head portion of the first towel cloth. In some embodiments, the elastic band is substantially indented from the second towel cloth.

In some embodiments, a hair towel wrap includes an elastic band and a towel cloth. The towel cloth includes a head portion and a tail portion. A back of the head portion is attached to the elastic band and the elastic band extends from a center of the back of the head portion. The body portion extends forward from a front of the head portion that is opposite to the back of the head portion. The tail portion extends forward from the body portion and a length of the tail portion is of sufficient amount such that the tail portion can be tucked under the elastic band when the hair towel wrap is worn on a wearer's head. In some embodiments, the elastic band is substantially indented from the head portion of the towel cloth.

In some embodiments, the tail portion has a shape of a trigon. In some embodiments, the body portion has a shape of a rectangle.

In some embodiments, the elastic band is configured to expand and contract around the base of the wearer's head to adjust tension. In some embodiments, a thickness of the elastic band is 0.5 mm to 3 mm.

In some embodiments, the towel cloth is formed using at least one of: microfiber, microfiber fleece, bamboo, cotton, linen, tencelm, lyocell, hemp, or silk. In some embodiments, the elastic band is formed using at least one of: elastic fiber such as spandex (Lycra) or rubber, polyester, rayon, nylon, cotton, rubber (Latex), or polyurethane.

In some embodiments, the elastic band is substantially indented from alignment with the head portion to allow for expanding and contracting to adjust tension. The elastic band can extend symmetrically from the second towel cloth, allowing for additional tension with drying material contacting the wearer's face.

These and other aspects, features, and implementations can be expressed as apparatus, systems, components, and in other ways.

These and other aspects, features, and implementations will become apparent from the following descriptions, including the claims.

Previous approaches to this problem have included various designs of hair towel wraps and turbans. These solutions typically feature either a simple rectangular towel design or incorporate specialized pouches for containing the hair. However, these designs have consistently fallen short, with rectangular towels being too bulky and heavy, while turban-style wraps often feature hair pouches that are too small, narrow, and short to accommodate different hair types effectively.

The challenges with existing solutions are numerous. Rectangular towels tend to be unwieldy and prone to slipping, while turban-style wraps often lack adequate security and stability. Users frequently struggle with keeping these products in place, leading to constant readjustment and potential hair damage. Additionally, many existing products fail to accommodate the diverse range of hair types, lengths, and textures found among users.

The present invention addresses these challenges through an innovative design that combines functionality with user comfort. The hair towel wrap features an elastic band system that provides superior stability and adjustability, allowing it to accommodate various head sizes and hair types. The design prevents the need for complicated fastening mechanisms while ensuring the wrap stays securely in place.

In the following description, for the purposes of explanation, numerous specific details are set forth in order to provide a thorough understanding of the present embodiments. It will be apparent, however, that the present embodiments may be practiced without these specific details.

The present disclosure will be described with reference to the drawing figures, in which like reference numerals refer to like parts throughout. For purposes of clarity in illustrating the characteristics of the present disclosure, proportional relationships of the elements have not necessarily been maintained in the drawing figures. It will be understood that any dimensions included in the figures are simply provided as examples and dimensions other than those provided therein are also within the scope of the invention.

The embodiments described in the present disclosure are intended to provide sufficient detail to enable those skilled in the art to practice the invention. Other embodiments can be utilized and changes can be made without departing from the scope of the present invention. The disclosures provided herein are not to be taken in a limiting sense and shall not limit the scope of equivalents to which the appended claims are entitled.

Further, spatially relative terms, such as "forward," "front," "back," or "encompass," and the like, as well as structurally relative terms, such as "head," "body," or "tail," "upper," and the like, may be used herein for case of description to describe one element or feature's relationship to another element(s) or feature(s) as illustrated in the figures. The spatially relative terms and structurally relative terms are intended to encompass different orientations and relationships of the device and/or components of the device in use or operation in addition to the orientation and structural relations depicted in the figures. For example, the apparatus may be otherwise oriented (rotated 90 degrees or at other orientations) and the spatially relative descriptors used herein may likewise be interpreted accordingly.

In some embodiments of the present disclosure, the terms "about" and "substantially" can indicate a value of a given quantity that varies within 20% of the value (e.g., ±1%, ±2%, ±3%, ±4%, ±5%, ±10%, ±20% of the value). These values are merely examples and are not intended to be limiting. The terms "about" and "substantially" can refer to a percentage of the values as interpreted by those skilled in relevant art(s) in light of the teachings herein.

The present disclosures describe contoured hair towel wraps designed to accommodate different hair types, hair lengths, and head sizes. Compared to existing hair towels, the hair towel wraps described in the present disclosure provide greater stability and less slippage, sliding, or unraveling. In addition, the tail part of the hair towel wrap can be securely tucked under the elastic band when the hair towel wrap is worn to further secure the hair towel wrap.

The structures and components of the hair wrap described in the present application is carefully engineered to provide improved coverage and comfort. The hair towel cloth consists of a head portion, body portion, and tail portion, each dimensioned specifically to work in harmony. The elastic band, seamlessly integrated into the rear of the head portion, creates a secure fit while allowing for easy adjustment. This design provides that the wrap stays in place without creating unnecessary pressure or discomfort.

Figure 1B:
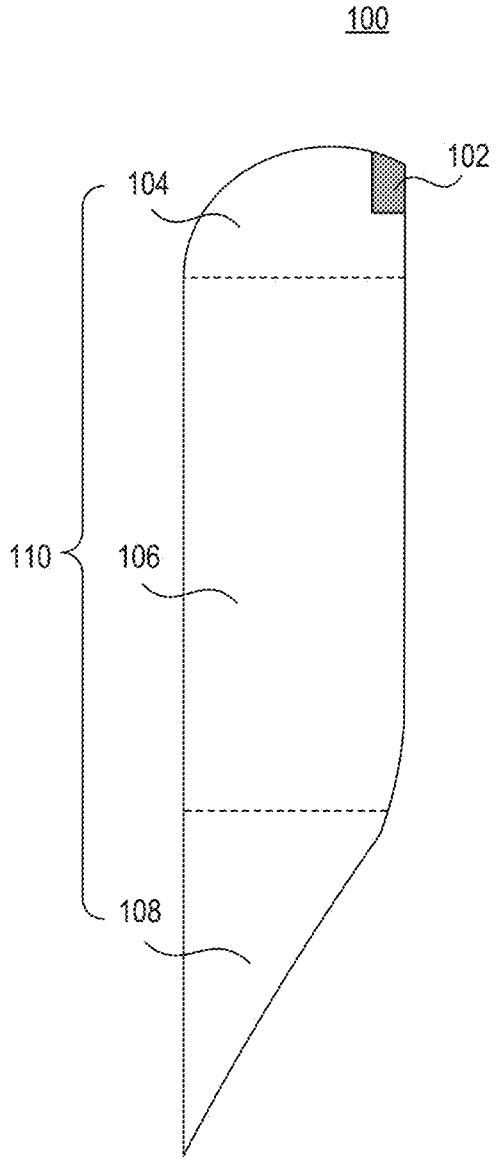

FIGS. 1A and 1B illustrate side views of a hair towel wrap 100 that showcase the innovative design elements and key structural components that enable superior stability and functionality, according to some embodiments. The figures demonstrate the essential measurements and proportions that allow the wrap to accommodate various hair types and head sizes while maintaining a secure fit. Hair towel wrap 100 comprises several integrated components working in harmony. Hair towel wrap 100 includes an elastic band 102 that allows for tension and stability around the base of the wearer's head, further providing the wearer with flexibility to perform other tasks. Hair towel wrap 100 features a hair towel cloth 110, which includes a head portion 104, a body portion 106, and a tail portion 108. Hair towel wrap 100 can include additional components (e.g., liners) that are not depicted in FIGS. 1A and 1B for simplicity. Hair towel cloth 110 can be made of at least one of microfiber, microfiber fleece, bamboo, cotton, linen, tencelm, lyocell, hemp, or silk material. These material options provide improved moisture absorption while maintaining comfort and durability.

Head portion 104 can be shaped to fit the wearer's head with one or more drying materials. In some implementations, a length $L_2$ of head portion 104 is about 5 inches, e.g., in a range from about 3 inches to about 7 inches. Body portion 106 connects the head portion and tail portion with the same or different drying material. Its seamless construction provides smooth contact with the head while maintaining structural integrity. In some implementations, body portion 106 can be in the shape of a rectangle. Body portion 106 extends forward from the front of the head portion, measuring about 20 inches in length ($L_3$). In some implementations, a length $L_3$ of body portion 106 is about 20 inches, e.g., in a range from about 18 inches to about 22 inches. This section maintains a rectangular shape and spans about 11 inches to 14 inches in width ($W_2$), providing ample coverage for various hair volumes. Tail portion 108 allows the wearer to tuck the towel under elastic band 102 for additional stability when worn on the wearer's head. In some implementations, tail portion 108 can be shaped like a trigon to avoid excess fabric. The length $L_4$ of tail portion 108 can be from about 13 inches to about 17 inches, providing sufficient material to be tucked under the elastic band when worn. The tail portion 108 extends forward from the body portion and can feature a distinctive trigon shape, specifically designed to minimize excess fabric while maintaining functionality. This unique shape and length combination provides secure fastening while preventing bulk. The total length ($L_5$) of the hair towel cloth 110 ranges from about 37 to about 43 inches, offering comprehensive coverage for various hair lengths and types. The measurements and shape of head portion 104, body portion 106, and tail portion 108 allow wearers of all hair types and head sizes to have full and comfortable coverage by a hair towel wrap having drying material and providing a secure and stable fit around the wearer's head without excess fabric.

The width $W_2$ of hair towel cloth 110 or body portion 106 can be from about 11 inches to about 14 inches. The length Ls of hair towel cloth 110 can be from about 37 inches to about 43 inches. These measurements allow for various head sizes of wearers to fit comfortably within the hair towel wrap and still receive the benefits of drying and stability.

Elastic band 102 is strategically positioned at the rear of the head portion 104, providing stability and tension control. Elastic band 102 is at the center back of head portion 104 and extends symmetrically to both sides of the base of the wearer's head. The material composition of elastic band 102 can include: clastic fiber such as spandex (Lycra) or rubber, polyester, rayon, nylon, cotton, rubber (Latex), polyurethane, or a blend of one of more of the above materials. Some combinations of materials for elastic band 102 include braided elastic made from polyester and rubber, knitted elastic made from polyester and spandex, and woven elastic made from polyester and rubber. Elastic band 102 can be sewn into the rear of head portion 104. Elastic band 102 can stretch to match the wearer's head shape and size thereby preventing slipping, unraveling, or sliding. In some implementations, the thickness of elastic band 102 is from about 0.5 mm to about 3 mm thick. The thickness of elastic band 102 allows for stability without molding or slow drying and without compromising drying efficiency.

The width and length of elastic band 102 are configured to allow for tension and stability on the wearer's head and easy drying when hung to dry. In some implementations, the width $W_1$ of elastic band 102 can be from about 2 inches to about 3 inches and the length $L_1$ of the elastic band can be from about 4 inches to about 6 inches. In some implementations, the ratio of a width of the clastic band 102 to a width of the hair towel 110 can be from about 1:2.44 to about 1:2.5 and allows for tension on the wearer's head and easy drying when hung to dry. The ratio of the elastic band width to the head portion width is a proportion that has been determined to provide improved fit and functionality across different head sizes. The features, ratio, and measurements as described in the first embodiment can also be applicable to other embodiments. Dimensions are indicated through measurements $W_1$ and $W_2$ for widths, and $L_1$ through $L_5$ for lengths, each carefully calculated to provide improved functionality and fit.

Figure 1C:
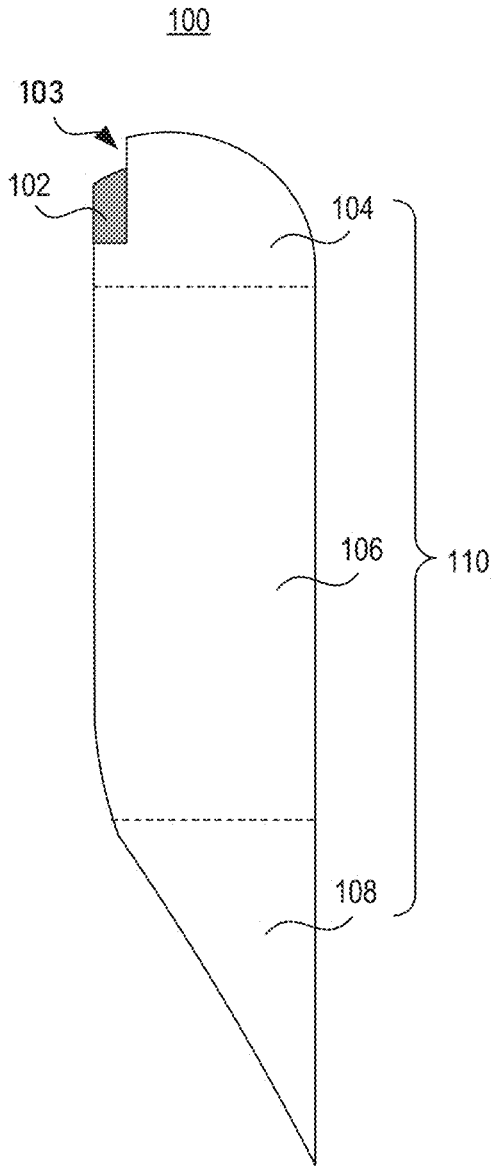
FIG. 1C illustrates another embodiment of a hair towel wrap where an elastic band is substantially indented or not fully aligned with a head portion of a hair towel cloth.

FIG. 1C illustrates a side view of a hair towel wrap 100, according to some embodiments, featuring a uniquely positioned elastic band that enhances the wrap's adaptability and comfort. Hair towel wrap 100 includes a substantially indented elastic band 102 that is not aligned with the head portion of hair towel cloth 110. This substantial indentation allows hair towel wrap 100 to stretch and enables hair towel wrap 100 to expand and contract around the base of the wearer's head to adjust tension for a comfortable fit when the hair is tucked in under elastic band 102 or the wearer has thick hair volume. This positioning serves multiple purposes: it enables a tighter fit around the wearer's head regardless of whether the tail portion is tucked under the elastic band, and it allows the hair towel wrap to expand and contract more effectively to accommodate varying hair volumes. The indentation feature as described in this embodiment can also be applicable to other embodiments. The elastic band's positioning, particularly in FIG. 1C, demonstrates the design's adaptability to different wearing configurations.

Figure 1D:
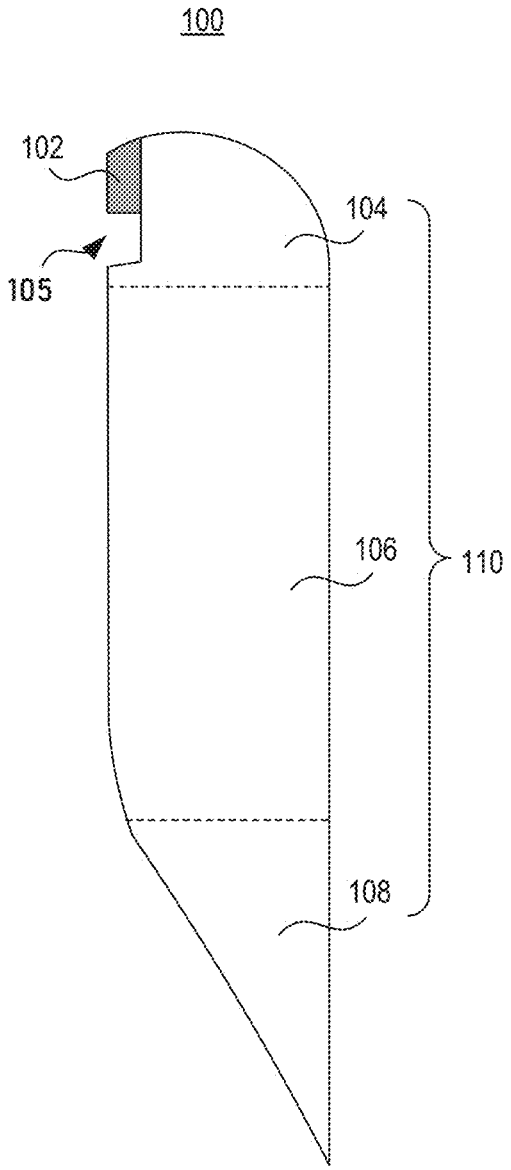
FIG. 1D illustrates another embodiment of a hair towel wrap where a gap is formed between a rear end of an elastic band and a head portion of a hair towel cloth.

FIG. 1D illustrates a side view of a hair towel wrap 100, according to some embodiments, where a gap is formed between a rear end of an elastic band and a head portion of the hair towel cloth. For example, elastic band 102 is attached to head portion 104 of hair towel cloth 110, and at least one side of elastic band 102 is not directly in contact with head portion 104 resulting in a gap 105 formed between elastic band 102 and head portion 104. In some embodiments, gap 105 can extend into body portion 106. In some embodiments, other embodiments of the present disclosure can also incorporate the elastic band and gap configurations illustrated in FIG. 1D. For example, the embodiments described further below in FIGS. 3A-3C and 4A-4C can also include a gap between the elastic band and the hair towel cloth. In some embodiments, the hair towel wrap can include both an indentation and a gap as described in FIGS. 1C and 1D, respectively. In some embodiments, the hair towel wrap can include one of the indentation and gap features to provide a more secure and comfortable fit for the wearer.

The materials and measurements have been carefully selected to enhance functionality. The towel cloth can be made from various absorbent materials, including microfiber, bamboo, or cotton, while the elastic band incorporates materials like spandex or rubber for durability and flexibility. The specific dimensions of each component have been tested to provide maximum effectiveness for all users.

The overall design incorporates specific features to address common issues with conventional hair towels. The elastic band's positioning and material properties prevent slipping, unraveling, or sliding during use. The seamless integration of the elastic band into the rear of the head portion eliminates the need for additional fastening mechanisms while providing superior stability. The carefully calculated dimensions of each component provides that the wrap can accommodate various hair types and lengths while maintaining a comfortable, non-bulky fit.

The figures illustrate how the components work together to create a secure and comfortable hair drying solution. The elastic band's ability to stretch and conform to different head shapes, combined with the strategic proportions of the head, body, and tail portions, enables the wrap to provide consistent performance across various user needs. The design's versatility is particularly evident in how the tail portion can be effectively tucked under the elastic band, creating a secure closure that maintains stability throughout use.

Figure 2A:
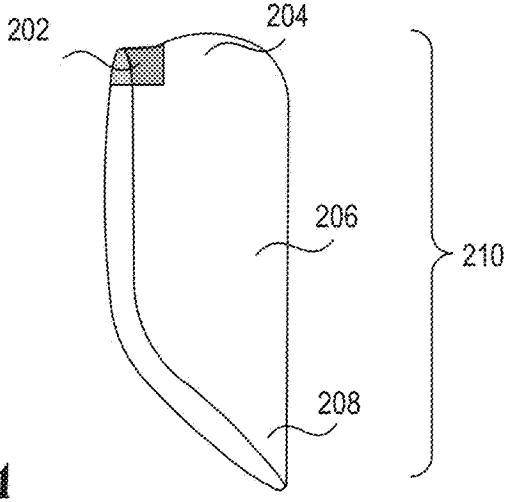
FIG. 2A shows a perspective side view of a hair towel wrap in accordance with one or more embodiments.
Figure 2B:
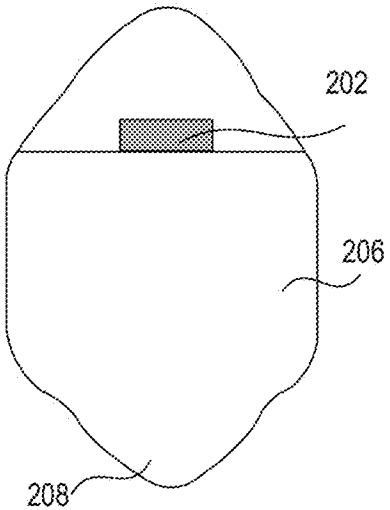
FIGS. 2B and 2C illustrate a top view of the front side and back side of a hair towel wrap, respectively.
Figure 2C:
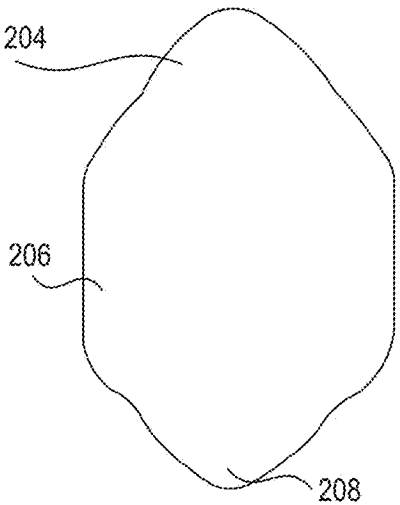

FIG. 2A provides a perspective view of a side of hair towel wrap 100, while FIGS. 2B and 2C illustrate top views of the front and back of hair towel wrap 100, respectively. Together, these figures demonstrate the three-dimensional structure of the wrap and how its components integrate to create a functional hair drying solution. The figures showcase the wrap's design elements from multiple angles, highlighting the relationship between the elastic band, head portion, body portion, and tail portion.

The hair towel wrap shown in these figures features several key components working in concert. Elastic band 202 provides essential stability at the rear of head portion 204. Body portion 206 extends forward from the head portion, leading to tail portion 208, with all components combining to form the complete towel cloth 210. The front view in FIG. 2B and back view in FIG. 2C particularly emphasize how these components interact and align to create a secure and comfortable fit, while maintaining the proper proportions and measurements necessary for improved functionality. The figures demonstrate the wrap's ability to provide complete coverage while maintaining a secure fit. The perspective view in FIG. 2A shows how the elastic band 202 integrates with the head portion 204 to create a stable foundation, while the top views in FIGS. 2B and 2C illustrate how the body portion 206 and tail portion 208 extend and align to provide comprehensive coverage. This multi-angle presentation helps visualize how the wrap prevents slipping, unraveling, or sliding during use, addressing common issues found in conventional hair towels.

Figure 3A:
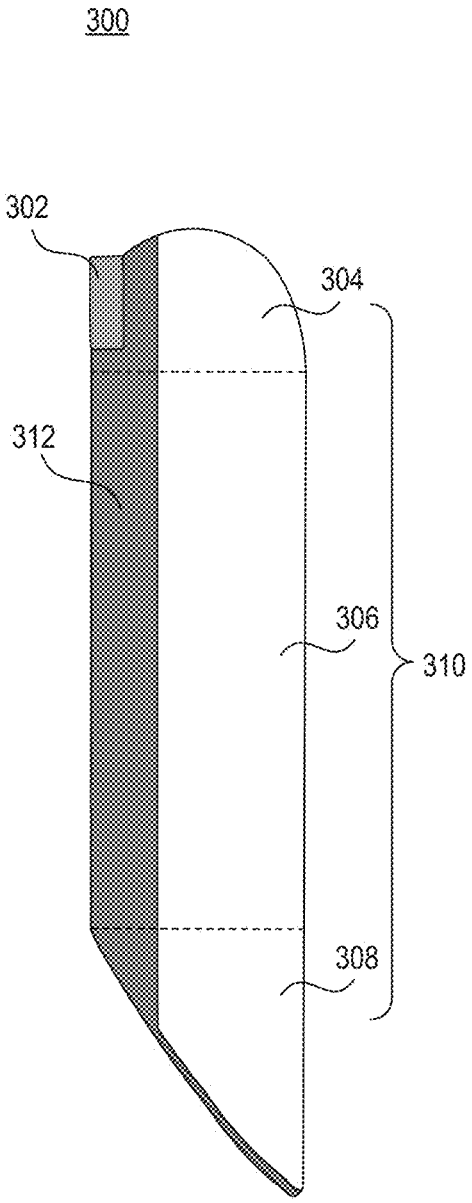
FIGS. 3A and 3B illustrate side views of another embodiment of a hair towel wrap having a second hair towel cloth as well as the portions from the first hair towel cloth and elastic band.
Figure 3B:
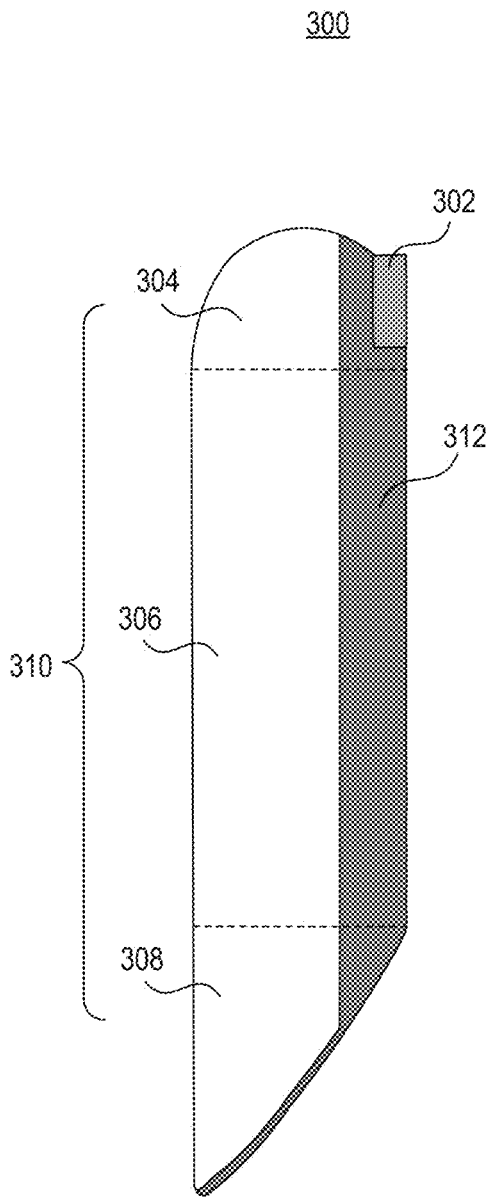

FIGS. 3A and 3B illustrate side views of hair towel wrap 300, according to some embodiments. Hair towel wrap 300 features a dual-layer design with a first towel cloth and a second towel cloth encompassing the elastic band. These embodiments depicted in FIGS. 3A and 3B include a first hair towel cloth 310 having a head portion 304, a body portion 306, a tail portion 308, a second hair towel cloth 312, and an elastic band 302. Second hair towel cloth 312 allows for absorbing and hiding stains from at least hair dye, makeup, or residue. The composition, measurements, shapes, and dimensions of first hair towel cloth 310 and its components can be similar to hair towel cloth 110 described in FIGS. 1A and 1B, and are not discussed in detail herein for simplicity.

In some embodiments, second towel cloth 312 matches the combined length of the head and body portions 304 and 306 of first towel cloth 310, providing additional absorption and comfort. Elastic band 302 attaches to the center back of second towel cloth 312, creating a secure foundation for the entire structure. This design allows for enhanced drying capability while maintaining stability and case of use.

Figure 3C:
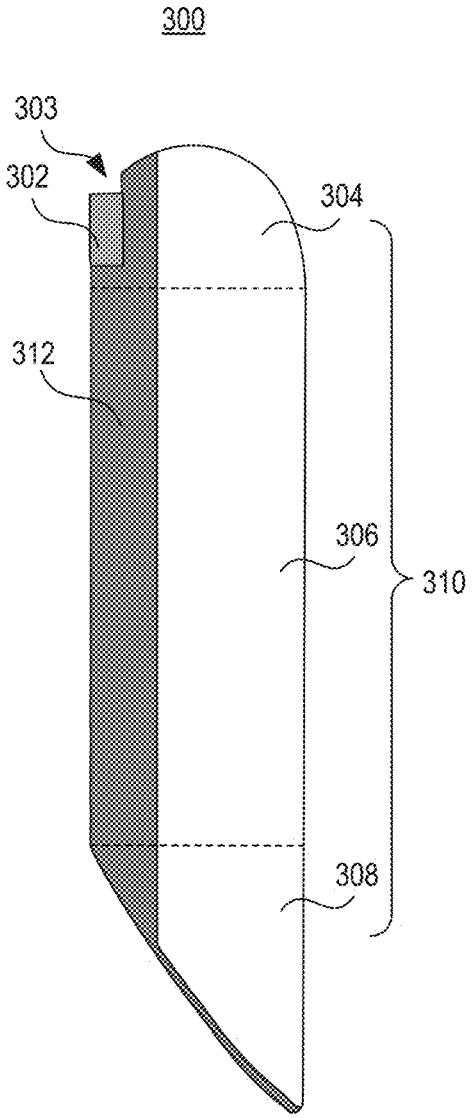
FIG. 3C illustrates another embodiment of a hair towel wrap where an elastic band is substantially indented or not fully aligned with a head portion of a hair towel cloth.

FIG. 3C illustrates a side view of a hair towel wrap 300, according to some embodiments, featuring a uniquely positioned elastic band that enhances the wrap's adaptability and comfort. Hair towel wrap 300 includes a substantially indented elastic band 302 that is not aligned with the head portion of first hair towel cloth 310. Similar to indentation 103 described in FIG. 1C, indentation 303 shown in FIG. 3C also allows hair towel wrap 400 to stretch, expand, and contract around the base of the wearer's head to adjust tension for a comfortable fit. Indentation 303 provides similar benefits as indentation 103. For example, the intentional positioning of the indentations enables a tighter fit around the wearer's head and allows the hair towel wrap to expand and contract more effectively to accommodate varying hair volumes. The elastic band's positioning shown in FIG. 1C demonstrates the design's adaptability to different wearing configurations.

Figure 4C:
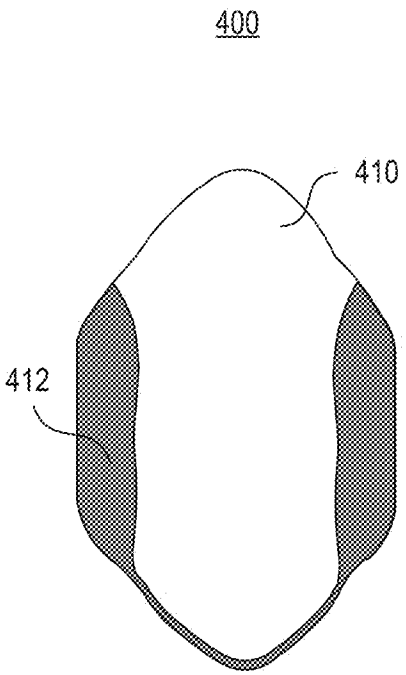
FIGS. 4B and 4C respectively illustrate top views of the front side and back side of a hair towel wrap.
Figure 4B:
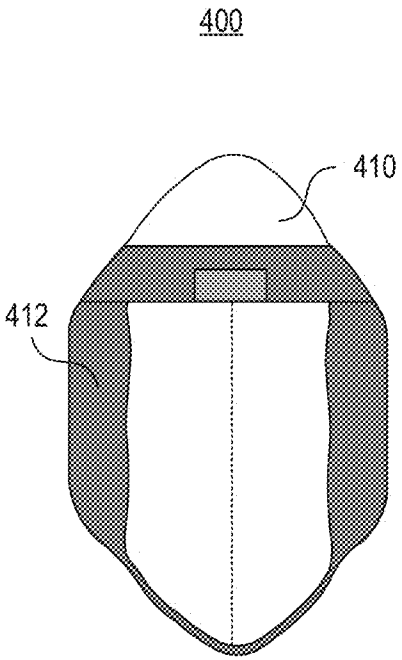
Figure 4A:
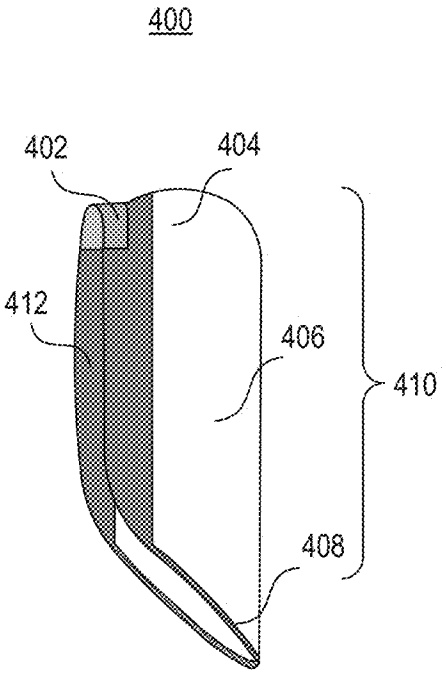
FIG. 4A shows a perspective side view of another embodiment of a hair towel wrap.

FIG. 4A illustrates a perspective view of a side of hair towel wrap 400. FIGS. 4B and 4C are top views of the front and back of hair towel wrap 400, respectively. Each of the components depicted in hair towel wrap of FIGS. 4A-4C can be similar to those depicted in FIGS. 3A-3C, respectively.

For example, hair towel wrap 400 includes elastic band 402, first hair towel cloth 410, and second hair towel 412. Similarly, first hair towel cloth 410 can include a head portion 404, a body portion 406, and a tail portion 408. Similar elements in FIGS. 4A-4C are assigned the same reference numerals.

The dual-layer configuration presented in FIGS. 3A-3C and 4A-4C represents an enhanced version of the hair towel wrap that incorporates additional features for improved performance and comfort. For example, similar to the embodiments described in FIGS. 1A-1D, 2A-2C, and 3A-3C, first towel cloth 410 includes a head portion 404, a body portion 406 extending forward from the head portion, and a tail portion 408 extending from body portion 406. This first layer maintains the dimensions established in the claims, with the body portion measuring about 20 inches in length and the tail portion ranging from about 13 inches to about 17 inches.

Similar to second towel cloth 312, second towel cloth 412 introduces an additional layer of functionality to the design. This second layer encompasses elastic band 402 and has a length that substantially matches the combined length of the head and body portions 404 and 406 of first towel cloth 410. Similar to elastic band 302, elastic band 402 is attached to the center of the back of the second towel cloth, creating a secure foundation for both layers. This configuration allows the second towel cloth to provide additional drying material that contacts the wearer's face while maintaining the stability and security of the original design.

Elastic band 402 (similar to elastic band 302) maintains its role in providing adjustable tension and security. It continues to incorporate materials such as spandex, rubber, polyester, rayon, nylon, cotton, latex, or polyurethane, allowing it to expand and contract effectively around the base of the wearer's head. The band's width can be about 2 inches to about 3 inches, with a length of about 4 inches to about 6 inches, providing tension control across various head sizes.

The figures demonstrate how the second towel cloth integrates seamlessly while providing additional benefits. The second towel cloth layer allows for enhanced absorption and comfort while maintaining the secure fit enabled at least by the elastic band. The dual-layer configuration is particularly effective at absorbing and hiding stains from hair dye, makeup, or residue, adding practical functionality beyond basic hair drying. For example, the second towel cloth can be formed using a material different from that of the first towel cloth. In some embodiments, the second towel cloth can be formed using a material that has a different moisture absorbent rate than the first towel cloth. In some embodiments, the second towel cloth can be formed using a different (e.g., darker) color from the first towel cloth to better hide makeup residue. In some embodiments, the second towel cloth can be formed using similar or the same material as the first towel cloth.

The perspective view in FIG. 4A and the top views in FIGS. 4B and 4C illustrate how the components work together to create a comprehensive hair drying solution. The elastic band's ability to secure both layers while maintaining proper tension demonstrates the design's versatility and effectiveness. The second towel cloth's integration with the elastic band provides that both layers remain stable and properly aligned during use, while the tail portion can still be effectively tucked under the elastic band for additional security.

FIGS. 5 through 9 illustrate the hair towel wrap used in the steps the wearer can take to wear the hair towel wrap with the tail portion tucked in, according to some embodiments. The configurations of the hair towel wrap are applicable in any of the embodiments described in the present disclosure, for example, the embodiments described in FIGS. 1A-1D, 2A-2C, and 3A-3C. These figures demonstrate practical applications of the hair wrap's innovative design features, showing how a wearer can achieve improved coverage and stability through a series of simple movements. The sequence begins with the initial placement of the wrap on the head and concludes with securing the tail portion under the elastic band, highlighting the user-friendly nature of the design.

Figure 6:
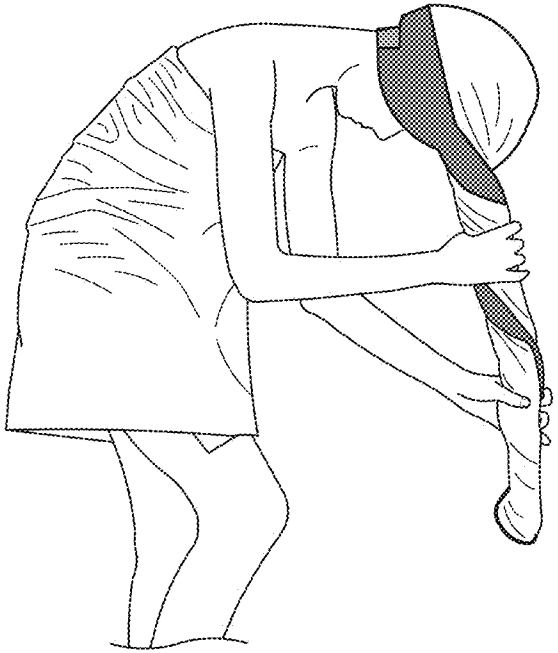
FIGS. 5, 6, 7, 8, and 9 show a perspective view of a method of the wearer using an embodiment of a hair towel wrap where the wearer tucks in the tail portion of a hair towel cloth under an elastic band.
Figure 5:
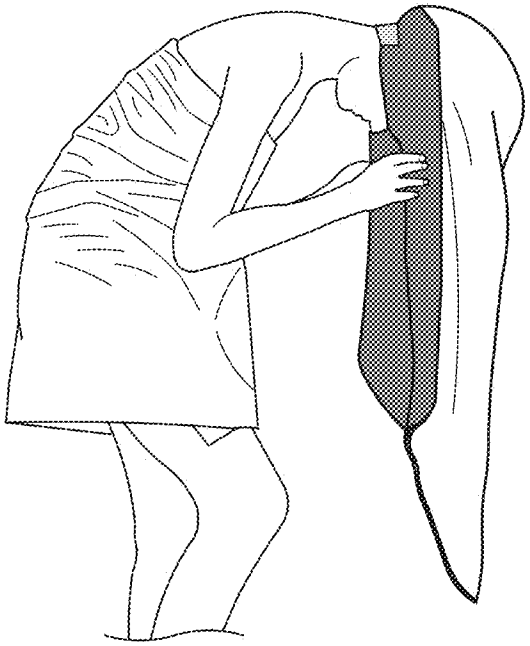

FIG. 6 illustrates the wrapping and twisting process, where the body portion, measuring about 20 inches in length and maintaining its rectangular shape, is used to enclose the hair. The towel cloth's width of about 11 inches to about 14 inches provides ample coverage while preventing excess bulk. The material composition, which can include microfiber, microfiber fleece, bamboo, cotton, linen, tencelm, lyocell, hemp, or silk, provides effective moisture absorption during this stage.

Figure 7:
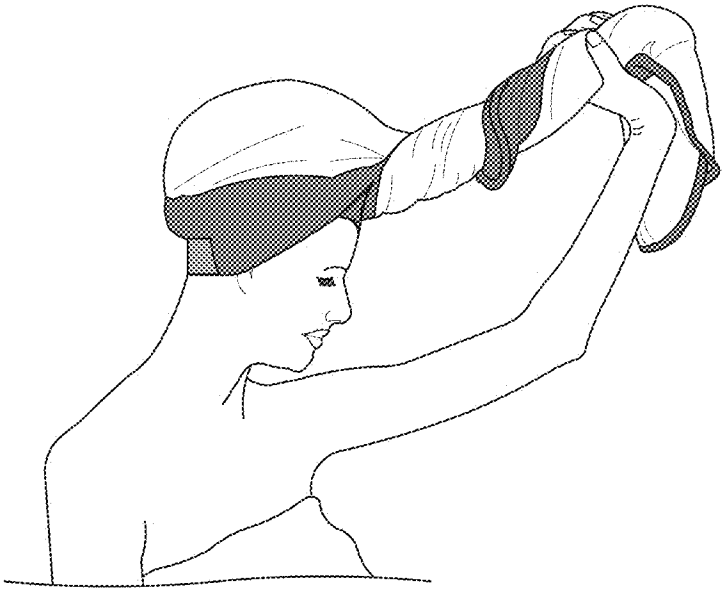

FIG. 7 shows a step of lifting and positioning the twisted turban shape over the head. This movement demonstrates how the total length of about 37 inches to about 43 inches accommodates various hair lengths and volumes while maintaining stability. The elastic band's thickness of about 0.5 mm to about 3 mm allows it to maintain tension without creating discomfort or impeding the positioning process.

Figure 8:
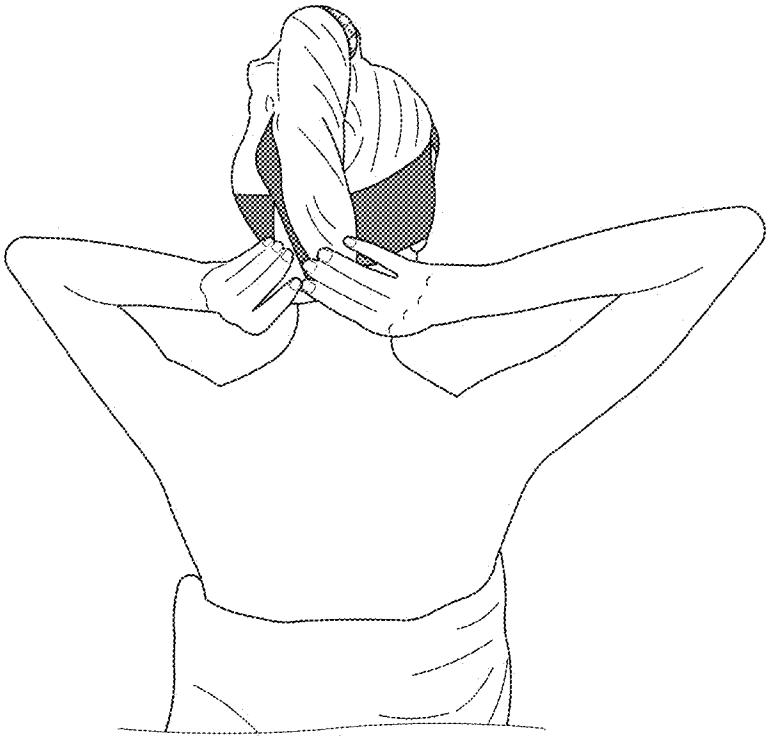

FIG. 8 illustrates the final securing step, where the tail portion, measuring about 13 inches to about 17 inches in length and featuring a trigon shape, is tucked under the elastic band. This step showcases how the ratio of about 1:2.5 between the elastic band width and head portion width enables secure fastening while maintaining comfort. The elastic band's ability to expand and contract provides a snug fit while accommodating the additional material of the tucked tail portion.

Figure 9:
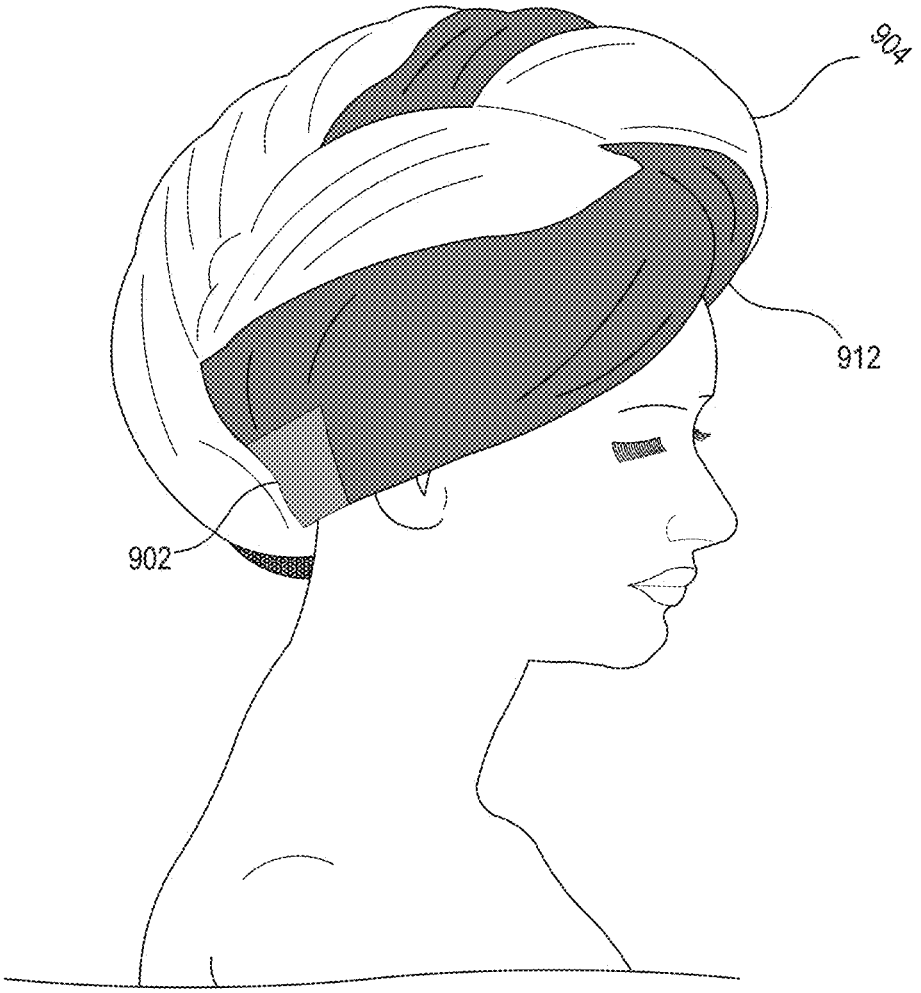

FIG. 9 demonstrates the completed configuration, showing how all components work together to create a secure and comfortable fit. The elastic band's seamless integration into the rear of the head portion prevents slipping, unraveling, or sliding during use. The body portion's rectangular shape provides consistent coverage, while the trigon-shaped tail portion remains securely tucked under the elastic band, demonstrating how the design eliminates the need for additional fastening mechanisms like buttons or straps.

The present disclosure offers significant advantages over traditional hair drying solutions. The elastic band system provides unprecedented stability and security, eliminating the common problem of slipping and readjustment found in conventional towels and turban wraps. The carefully calculated dimensions and proportions provide that the wrap accommodates all hair types and lengths while maintaining a comfortable, non-bulky fit. The elimination of complicated fastening mechanisms like buttons, loops, or straps simplifies the user experience while improving reliability.

The design's versatility and effectiveness extend beyond mere hair drying. The secure fit allows users to perform other activities while their hair dries, increasing productivity and convenience. The materials used promote gentle, natural drying that helps prevent hair damage commonly associated with heat-based drying methods. The wrap's ability to stay in place without constant adjustment reduces hair breakage and strain, while the optional second layer provides additional absorption and protection for the user's face and neck area.

The description and drawings herein are illustrative and are not to be construed as limiting. Numerous specific details are described to provide a thorough understanding of the disclosure. However, in certain instances, well-known details are not described in order to avoid obscuring the description. Further, various modifications may be made without deviating from the scope of the embodiments.

The terms used in this specification generally have their ordinary meanings in the art, within the context of the disclosure, and in the specific context where each term is used. Certain terms that are used to describe the disclosure are discussed above, or elsewhere in the specification, to provide additional guidance to the practitioner regarding the description of the disclosure. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that the same thing can be said in more than one way.

Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any term discussed herein is illustrative only and is not intended to further limit the scope and meaning of the disclosure or of any exemplified term. Likewise, the disclosure is not limited to various embodiments given in this specification.

It is to be understood that the embodiments and variations shown and described herein are merely illustrative of the principles of this invention and that various modifications may be implemented by those skilled in the art.

What is claimed is:

1. A hair towel wrap, comprising:
- a first towel cloth comprising:
  - a head portion;
  - a body portion extending from the head portion; and
  - a tail portion,
    - wherein the tail portion is attached to and extends from the body portion;
- an elastic band,
  - wherein a length of the elastic band is less than a length of the head portion of the first towel cloth,
  - wherein a width of the elastic band is less than half a width of the first towel cloth,
  - wherein at least one side of the elastic band is not directly in contact with the first towel cloth,
  - wherein the elastic band is substantially indented from the head portion of the first towel cloth, and
  - wherein the tail portion is shaped and sized to be tucked under the elastic band when the hair towel wrap is worn on a wearer's head; and
- a second towel cloth encompassing the elastic band,
  - wherein a width of the second towel cloth is greater than a width of the elastic band,
  - wherein a length of the second towel cloth is substantially the same as a total length of the head portion and the body portion of the first towel cloth, and
  - wherein the elastic band is attached to a central location on one side of the second towel cloth.

2. The hair towel wrap of claim 1, wherein the tail portion has a triangular shape.

3. The hair towel wrap of claim 1, wherein the body portion has a rectangular shape.

4. The hair towel wrap of claim 1, wherein the elastic band is configured to expand and contract around a base of the wearer's head to adjust tension.

5. The hair towel wrap of claim 1, wherein at least one of the first towel cloth or the second towel cloth comprises at least one of: microfiber, microfiber fleece, bamboo, cotton, linen, tencelm, lyocell, hemp, or silk.

6. The hair towel wrap of claim 1, wherein a width of at least one of the first towel cloth or the second towel cloth is in a range from 11 inches to 14 inches.

7. The hair towel wrap of claim 1, wherein a length of at least one of the first towel cloth or the second towel cloth is in a range from 37 inches to 43 inches.

8. The hair towel wrap of claim 1, wherein a width of the elastic band is in a range from 2 inches to 3 inches.

9. The hair towel wrap of claim 1, wherein a length of the elastic band is in a range from 4 to 6 inches.

10. The hair towel wrap of claim 1, wherein a length of the body portion is about 20 inches.

11. The hair towel wrap of claim 1, wherein a length of the tail portion is in a range from 13 to 17 inches.

12. The hair towel wrap of claim 1, wherein a length of the head portion is about 5 inches.

13. The hair towel wrap of claim 1, wherein a ratio of a width of the elastic band to a width of the head portion is in a range from 1 to 2.5.

14. The hair towel wrap of claim 1, wherein the elastic band comprises at least one of: elastic fiber such as spandex (Lycra) or rubber, polyester, rayon, nylon, cotton, rubber (Latex), or polyurethane.

15. The hair towel wrap of claim 1, wherein a thickness of the elastic band is in a range from 0.5 mm to 3 mm.

16. A hair towel wrap, comprising:
- a first towel cloth comprising:
  - a head portion;
  - a body portion extending from the head portion; and
  - a tail portion,
    - wherein the tail portion is attached to and extends from the body portion;
- an elastic band,
  - wherein a length of the elastic band is less than a length of the head portion of the first towel cloth,
  - wherein at least one side of the elastic band is not directly in contact with the first towel cloth; and
- a second towel cloth encompassing the elastic band,
  - wherein a length of the second towel cloth is substantially the same as a total length of the head portion and the body portion of the first towel cloth.

17. The hair towel wrap of claim 16, wherein a width of the second towel cloth is greater than a width of the elastic band, and wherein the width of the elastic band is less than half a width of the first towel cloth.

18. The hair towel wrap of claim 16, wherein the first towel cloth is of a material different from the second towel cloth.

19. The hair towel wrap of claim 16, wherein the tail portion is shaped and sized to be tucked under the elastic band when the hair towel wrap is worn on a wearer's head.

20. The hair towel wrap of claim 16, wherein the elastic band is substantially indented from the head portion of the first towel cloth.

* * * * *